United States Patent [19]

Jorgensen

[11] 4,073,211

[45] Feb. 14, 1978

[54] COLLAPSIBLE GUITAR

[75] Inventor: Allen C. Jorgensen, Coulee City, Wash.

[73] Assignee: The Raymond Lee Organization, Inc., New York, N.Y. ; a part interest

[21] Appl. No.: 708,438

[22] Filed: July 26, 1976

[51] Int. Cl.[2] ..... G10D 3/00; G10D 1/08

[52] U.S. Cl. ..... 84/291; 84/267; 84/293; 84/307

[58] Field of Search ..... 84/293, 291, 275, 307, 84/267

[56] References Cited

U.S. PATENT DOCUMENTS

| | | | |
|---|---|---|---|
| 519,409 | 5/1894 | Middlebrooke | 84/293 |
| 2,464,100 | 3/1949 | Ruggiero | 84/275 |
| 2,803,982 | 8/1957 | Gassin et al. | 84/275 |
| 3,657,462 | 4/1972 | Robinson | 84/293 |

FOREIGN PATENT DOCUMENTS

| | | | |
|---|---|---|---|
| 516,455 | 2/1955 | Italy | 84/293 |

*Primary Examiner*—Stephen J. Tomsky
*Attorney, Agent, or Firm*—Howard I. Podell

[57] ABSTRACT

A guitar, the neck of which is hinged to the guitar body so as to be foldable into a shaped recess in the back of the body. The strings of the guitar are individually attached at one end to the neck and at the other end to a common bridge unit. The bridge unit is attached to a first clamp on the face of the body in the erect position of the neck and to a second clamp recessed below the face side of the body in the folded neck position. Grooves are formed in the guitar body to individually retain each guitar string in the folded neck position.

3 Claims, 5 Drawing Figures

COLLAPSIBLE GUITAR

SUMMARY OF THE INVENTION

My invention is a guitar, the neck of which is hinged to the guitar body so as to be foldable into a shaped recess in the back of the body. The strings of the guitar are individually attached at one end to the neck and at the other end to a common bridge unit. The bridge unit is attached to a first clamp on the face of the body in the erect position of the neck and to a second clamp recessed below the face side of the body in the folded neck position. Grooves are formed in the guitar body to individually retain guitar string in the folded neck position.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
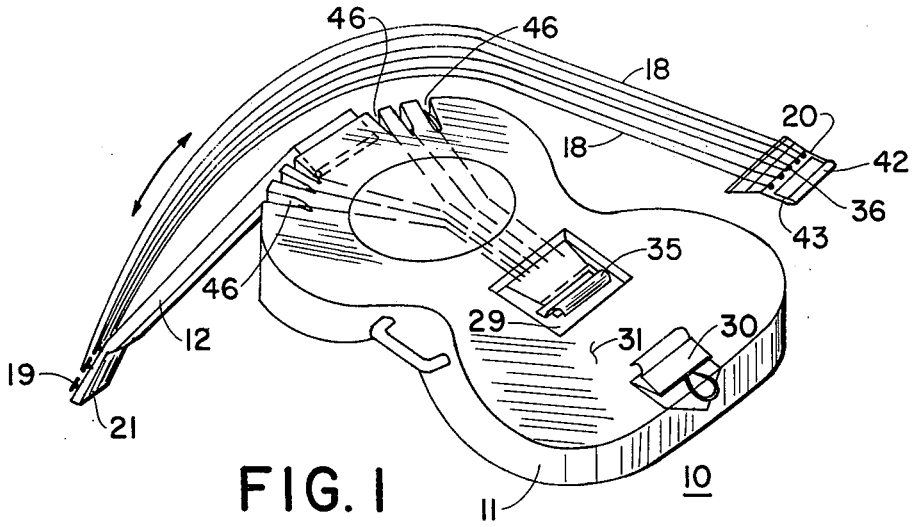
FIG. 1 is a perspective view of the invention in the partially folded position.

Turning now descriptively to the drawings, in which similar reference characters denote similar elements throughout the several views, FIGS. 1–5 illustrate the collapsible guitar 10 which is formed of a shaped guitar body 11 mounted to a neck 12 by a hinge 13. A shaped open recess 25 is formed in the back panel 15 of the guitar body 11 of a size to contain the neck 12 when folded one hundred and eighty degrees about hinge 13 into recess 25. Six strings 18 are individually fastened in conventional manner by fasteners 19 to the external end section 21 of the neck 12, at a first end of each string 18, with the second end of each string 18 fastened to a bridge unit 20.

Figure 2:
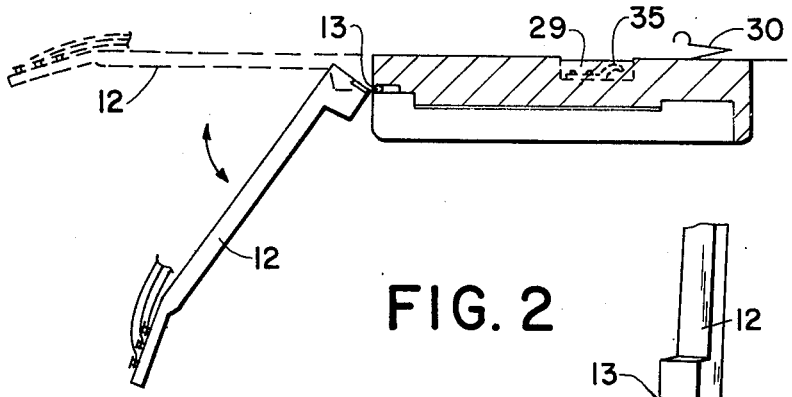
FIG. 2 is a side view of the invention in a partially folded position.
Figure 3:
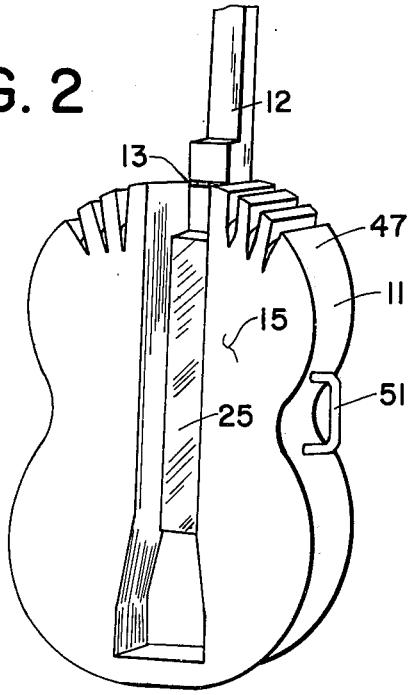
FIG. 3 is a rear perspective view of the guitar body.

Bridge unit 20 is detachably fastened, in the erect position of the neck 12, shown in dash lines in FIG. 2, to end spring clamp 30 mounted on the face panel 31 of the body 11. When neck 12 is to be folded, bridge unit 20 is detached from end spring clamp 30 and fastened to storage spring clamp 35 mounted in an open recess 29 of the face panel 31 of the body 11. Bridge unit 20 is fitted with clasps 36 for individual attachment of each guitar string 18 over upraised bridge fret 41, with bridge unit 20 formed with a handle section 42 of circular cross-section mounted by a pair of arms 43 to project beyond the forward section of bridge unit 20 and to serve as an attachment grip about spring clamp 30 or clamp 35.

Figure 4:
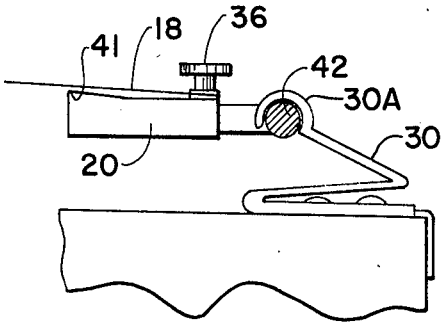
FIG. 4 is a side view of the first bridge clamp.
Figure 5:
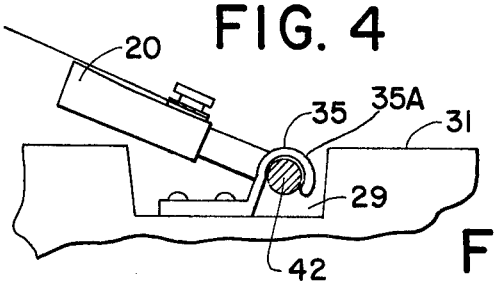
FIG. 5 is a side view of the second bridge clamp.

As shown in FIGS. 4 and 5, spring clamp 30 and spring clamp 35 are each formed with a projecting member 30A and 35A respectively, that is each bent, in cross-section in a semi-circular shape, of a size to grip about the handle section 42 of a bridge unit 20 so as to retain bridge unit 20, when so engaged.

A handle 51 is externally fixed to body 11 for carrying purposes.

Six grooves 46 are formed in the rear section of the face panel 31 extending to the rear side panel 47, with three grooves 46 located on each side of neck hinge 13. Each groove individually retains a string 18 when neck 12 is folded in recess 25 and bridge unit 20 fastened to storage clamp 35.

Storage spring clamp 35 is located so that when the neck is in the folded position, the bridge unit 20 fastened to clamp 35, the strings 18 are under less tension than when the neck is in the erect position and the bridge unit 20 is fastened to end spring clamp 30.

It is to be noted that the description of the preferred embodiment is in terms of a guitar but the invention is applicable to any string instrument such as a violin, cello fitted with a body attached to a projecting neck.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A string instrument in the form of a body fitted with a neck that projects beyond the body, on which neck, strings are fixed extending along the neck of the body, in which said body is joined to the neck by a hinge with said neck mounted to the hinge so as to pivot into a recess located in the body and extending from the back panel of the instrument, together with a bridge member to which one end of all the strings are fastenable, said bridge member of a shape to alternatively detachably fasten to first clamp means fixed to the face of the instrument body, or second clamp means fixed to a recess section of the instrument body, said first clamp means located in a position in which the strings are maintained in a first taut condition when the neck is folded to the erect playing position, with the bridge unit attached to said first clamp means, and said second clamp means located in a position in which the strings are maintained in a second taut condition when the neck is folded into the body recess, with the bridge unit attached to said second clamp means, said second taut condition being relatively slack as compared to said first taut condition.

2. The combination as recited in claim 1 in which the first and the second clamp means are each formed with a projecting member that is bent, in cross-section in an arcuate shape, and the bridge member is formed with a handle section of a generally circular shape in cross-section, said handle section of a shape to be detachably engaged by either projecting member of the first or second clamp member.

3. The combination as recited in claim 1 in which grooves are formed in the face panel of the body of a shape to each individually retain a separate string that joins the neck in the folded position to the bridge unit attached to the said clamp means.

* * * * *